US006224247B1

(12) United States Patent
Ashizawa

(10) Patent No.: US 6,224,247 B1
(45) **Date of Patent: *May 1, 2001**

(54) VEHICULAR LAMP

(75) Inventor: Kazuhisa Ashizawa, Shizuoka (JP)

(73) Assignee: Koito Manufacturing Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/136,621

(22) Filed: Aug. 20, 1998

(30) Foreign Application Priority Data

Sep. 4, 1997 (JP) ..... 9-239366

(51) Int. Cl.[7] ..... F21W 101/02; F21V 29/00
(52) U.S. Cl. ..... 362/547; 362/294; 362/345
(58) Field of Search ..... 362/294, 345, 362/373, 376, 547

(56) References Cited

U.S. PATENT DOCUMENTS 4,363,083 * 12/1982 Tanaka et al. ..... 362/294
4,833,572 * 5/1989 Nagengast et al. ..... 362/294
4,849,865 * 7/1989 Van Duyn ..... 362/294
4,926,293 * 5/1990 Saba ..... 362/294
5,010,453 4/1991 Ketterman ..... 362/61
5,497,308 3/1996 Ohtsuka et al. ..... 362/294
5,562,337 10/1996 Takinami et al. ..... 362/61
5,609,407 3/1997 Yanagihara et al. ..... 362/61
5,611,612 3/1997 Choji et al. ..... 362/61

* cited by examiner

*Primary Examiner*—Laura K. Tso
(74) *Attorney, Agent, or Firm*—Sughrue, Mion, Zinn, Macpeak & Seas, PLLC

(57) ABSTRACT

Disclosed is a vehicular lamp in which a closed lamp chamber is defined by a lamp body and a front lens, a bulb is disposed within the lamp chamber, and air holes for breathing action are formed in the rear wall of the lamp body. In the vehicular lamp, the air holes are elongated in shape, whereby the air holes each having a large diameter may be formed at desired positions of the rear wall of the lamp body where the air holes do not interfere with various members and components, such as the bulb-exchange opening, the aiming mechanism and the mounting bracket. With the structure, an air circulates within the lamp chamber in such a mode as to prevent moisture from being condensed on the front lens.

8 Claims, 7 Drawing Sheets

VEHICULAR LAMP

BACKGROUND OF THE INVENTION

1. Field of the Invention

The present invention relates to a vehicular lamp with breathing air holes formed in the rear wall of a lamp body, which cooperates with a front lens to define a lamp chamber.

2. Related Art

A conventional vehicular lamp of this type is typically illustrated in FIG. 7. The illustrated lamp is a vehicular headlamp. As shown, a lamp chamber of the headlamp is defined and hermetically closed by a lamp body 1 and a front lens 2. A reflector with a bulb, which is not shown (as a light source) inserted thereinto is supported by an aiming mechanism A such that it is tiltable back and forth as well as to the right and left. The aiming mechanism A is composed of two aiming screws 3 and 4 and one ball joint 5. An opening 1*a* for facilitating a bulb exchange is formed in the rear wall of the lamp body 1, and numeral 8 is a bracket used for fixedly mounting the headlamp on a vehicular body.

An air hole 6 is formed in the rear wall of the lamp body 1 as shown in FIGS. 7 and 8. The air hole 6 sets up a communication between the inside and outside of the lamp chamber. In other words, the vehicular lamp or its lamp chamber breathes through the air hole 6 to prevent dew from being formed on the front lens 2.

As illustrated in FIG. 8 in an enlarged view, the air hole 6 is defined by a cylindrical portion 1*b* protruded outward from the rear wall of the lamp body 1. A flexible tube 7 is fit to the cylindrical portion lb: one opened end of a flexible tube 7 is tightly coupled with the cylindrical portion 1*b*, while the other opened end is faced downward. Such a coupling of the flexible tube 7 makes it difficult for dust particles and water to enter the lamp chamber S through the air hole 6.

The diameter of the air hole 6 is small. Because of this, the breathing action of the lamp chamber is unsatisfactory. Further, the air passage continuous to the air hole 6 is possibly narrowed in its diameter or even closed, for example, where another member is put on the flexible tube 7. The breathing action, which is unsatisfactory, is thus further deteriorated. In this case, the dew-formation preventing effect is also deteriorated, as a matter of course.

One solution for this problem is to increase the diameter of the air hole 6 (which is circular in cross section) and the inside diameter of the flexible tube 7.

The rear wall of the lamp body 1 is generally curved in shape. Further, various members and components, such as the bulb-exchange opening 1*a*, the aiming mechanism A and the mounting bracket, are attached to the rear wall of the lamp body. For this reason, it is technically difficult to form the air hole 6 of the sufficiently large diameter at a desired location on the rear wall of the lamp body 1 without interfering with the above members and components.

SUMMARY OF THE INVENTION

The present invention was made in view of the foregoing difficulties accompanying the conventional vehicular lamp. Accordingly, an object of the present invention is to provide a vehicular lamp in which the air holes each having a sufficiently large diameter are formed at desired positions of the rear wall of the lamp body.

The above and other objects can be achieved by a provision of a vehicular lamp which, according to the present invention, includes a closed lamp chamber defined by a lamp body and a front lens, a light source disposed within the lamp chamber, and air holes for breathing action formed in the rear wall of the lamp body, wherein the air holes are formed by an elongating hole.

The rear wall of the lamp body is generally curved in shape, and hence includes a less flat area. Further, a light-source-exchange opening is formed in the rear wall, a bracket for mounting the vehicular lamp on a vehicle body is mounted on the rear wall while being extended outward therefrom. Further, the aiming mechanism for controlling the optical axis of the vehicular lamp sometimes is mounted on the rear wall. The formation of the opening and the attachment of the bracket and the aiming mechanism make it difficult to form the air hole (circular in cross section) of the sufficiently large diameter at a desired location on the rear wall of the lamp body without interfering with the other members and components of the lamp. This difficulty is overcome when the air holes are elongated in shape, however. To form a circular hole, a flat area equal to the area defined by the diameter of the circular hole is required. In this case, if the elongated hole is horizontally (vertically) oriented or elongated, a space extending in the horizontal (vertical) direction is large, but a space extending in the vertical (horizontal) direction is small. Therefore, a design freedom on the locations to form the air holes is added. Further, the elongating hole is equivalent to the hole whose diameter is increased, in its area.

According to another aspect of the invention, in the vehicular lamp each air hole is formed with a cylindrical upstanding wall passing through the rear wall of the lamp body, while being protruded rearward of the rear wall, a dust-blocking filter is put in the upstanding wall, and a rib for preventing the filter from slipping off the upstanding wall into the lamp chamber is provided on the front side of the upstanding wall, while extending along and in the lengthwise direction of the air holes.

Water and dust particles going to the inside of the lamp chamber through the air holes are blocked by the dust-blocking filter contained in the upstanding wall (air hole). Water that is splashed upward and will enter the lamp chamber through the air hole is blocked by the cylindrical upstanding wall protruding rearward of the rear wall of the lamp body before it reaches the dust-blocking filter. Since the filter is supported at its peripheral edge by the cylindrical upstanding wall, it is reliably held within the upstanding wall.

The rib prevents the filter from slipping off the upstanding wall into the lamp chamber. The rib extends along and in the lengthwise direction of the air hole. With provision of the rib, the shorter diameter of the elongated hole is reduced to make the slipping-off prevention more reliable.

Further, according to the present invention, the front end of the upstanding wall protrudes into the lamp chamber.

The cylindrical upstanding wall containing the dust-blocking filter protrudes to the front of the rear wall of the lamp body, so that the upstanding wall protrudes less from the rear side of the lamp body. With this structure, the cylindrical upstanding wall protrudes into the lamp chamber and out of the rear of the lamp chamber. Therefore, the space on the rear side of the lamp body is correspondingly broadened.

According to another aspect of the invention, the vehicular lamp is characterized in that A) each air hole is covered with an air passage housing for defining labyrinthine air passages continuous to the outside, and B) the air passage housing includes a) a second upstanding wall having a cut-out in the bottom and being disposed around the upstanding wall, b) a third upstanding wall having a cut-out in the bottom and being disposed around the second upstanding wall, the cut-out of the third upstanding wall being not vertically aligned with the cut-out of the second upstanding wall, and c) a swing cover extending forward from and along a thinned linear portion serving as a hinge which traverses the upper portion of the third upstanding wall, when the swing cover is lance coupled with the bottom portion of the third upstanding wall, the swing cover covering the end opening of the third upstanding wall.

The labyrinthine air passages in the housing covering the air hole blocks the entering of dust particles and water into the air hole. It is noted that the cut-outs of the second and third upstanding walls, which form the air holes, are formed in their bottom portions. This feature makes it for dust particles and water to enter the inside spaces of those upstanding walls. If entered, the particles and water naturally drop through the cut-offs by their weight, i.e., gravity.

The second and third upstanding walls, and the swing cover, which form the labyrinthine air passages, are formed integrally with the lamp body. This structural feature contributes to reduction of the number of the parts required for constructing the vehicular lamp. The labyrinthine air passages may be constructed in a simple manner that the swing cover is bent and lance coupled with the lower edge of the third upstanding wall. Where the air holes are formed with the upstanding walls, the swing cover functions as a holder member to hold the dust-blocking filters placed in the upstanding walls (air holes).

In addition, the air hole may be provided at a location above and near a light-source-exchange opening.

Air heated by the light source rises, and smoothly flows out of the lamp chamber through the air hole located above and near the light source.

Moreover, in the vehicular lamp of the invention, the air holes are classified into a first air hole being provided at a location above and near a light-source-exchange opening, and a second air hole being provided in one of the right and left portions of the rear wall of the lamp body at a location below the light-source-exchange opening and close to the side end of the right or left portion.

In the vicinity of the light-source-exchange opening, air heated by the light source as a heat source flows outside through the first air hole. Outside air is introduced into the lamp chamber through the second air hole being provided in one of the right and left portions of the rear wall of the lamp body at a location below the light-source-exchange opening and close to the side end of the right or left portion. Therefore, an active convection stream of air flows upward from the location close to the side end of the right or left portion, within the lamp chamber. The air stream flows through the entire space within the lamp chamber.

The first air hole may preferably be oriented horizontally, and the second air hole may preferably be oriented vertically.

The first air hole is horizontally elongated. This structural feature allows the air hole to be formed in region which is narrow in the vertical direction and above and near the light-source-exchange opening. The second air hole is vertically elongated. This structural feature allows the air hole to be formed in region which is narrow in the horizontal direction and close to the side end of the right or left portion of the rear wall of the lamp body.

DESCRIPTION OF THE PREFERRED EMBODIMENT

The preferred embodiment of the present invention will now be described with reference to the accompanying drawings.

Figure 1:
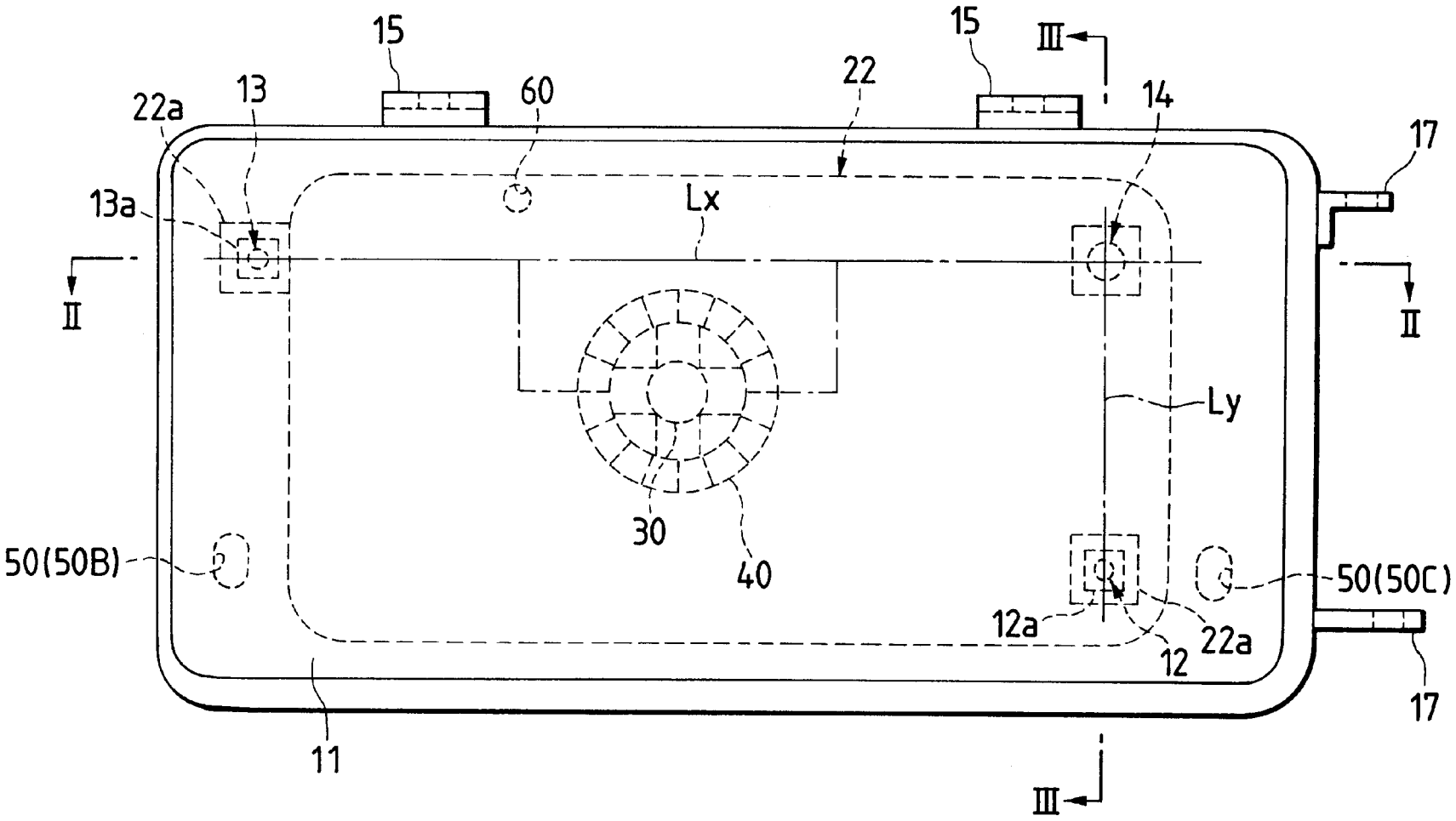
FIG. 1 is a front view showing a vehicular headlamp constructed according to the present invention.
Figure 2:
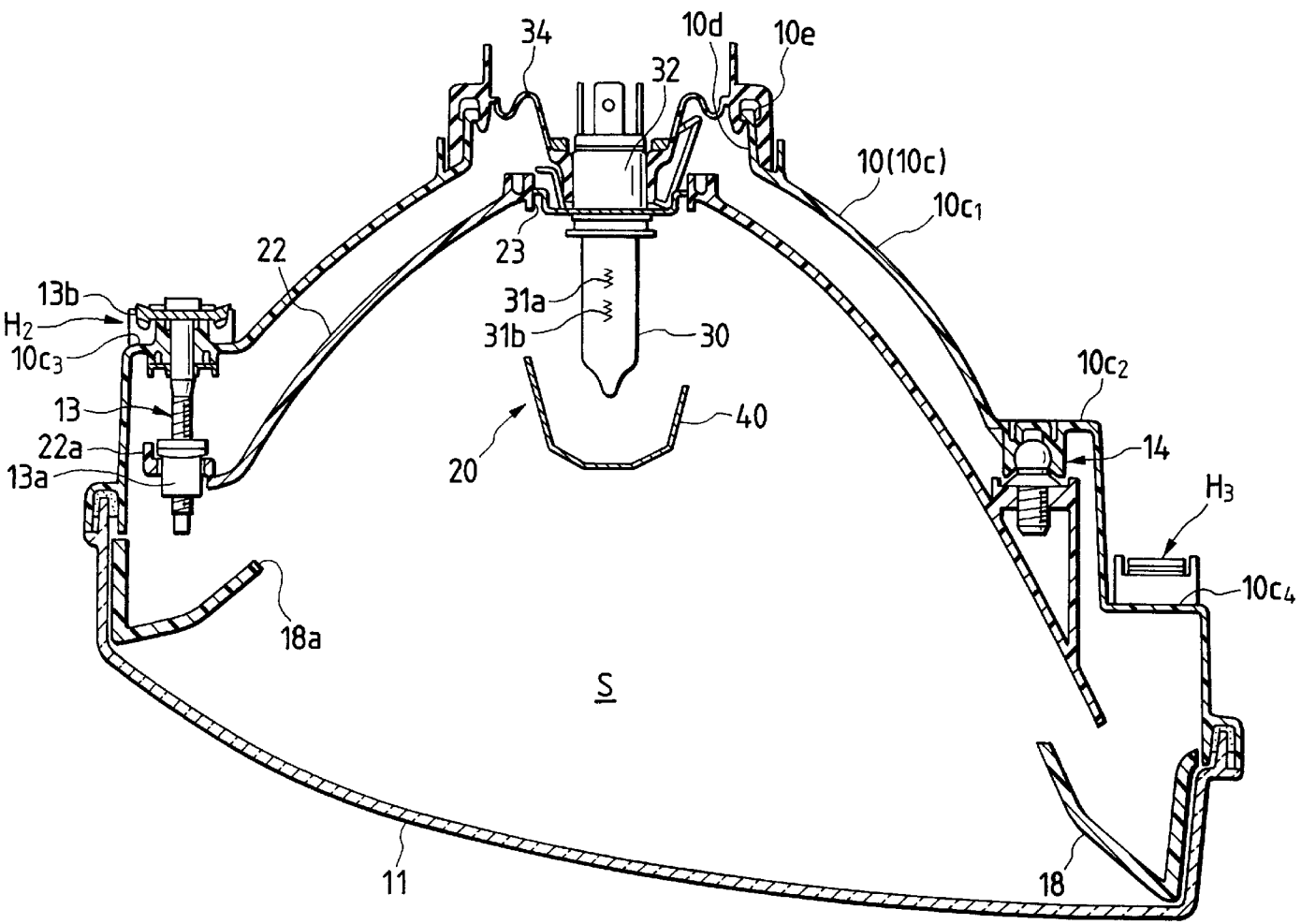
FIG. 2 is a horizontal sectional view showing the headlamp taken along a line II—II in FIG. 1.
Figure 3:
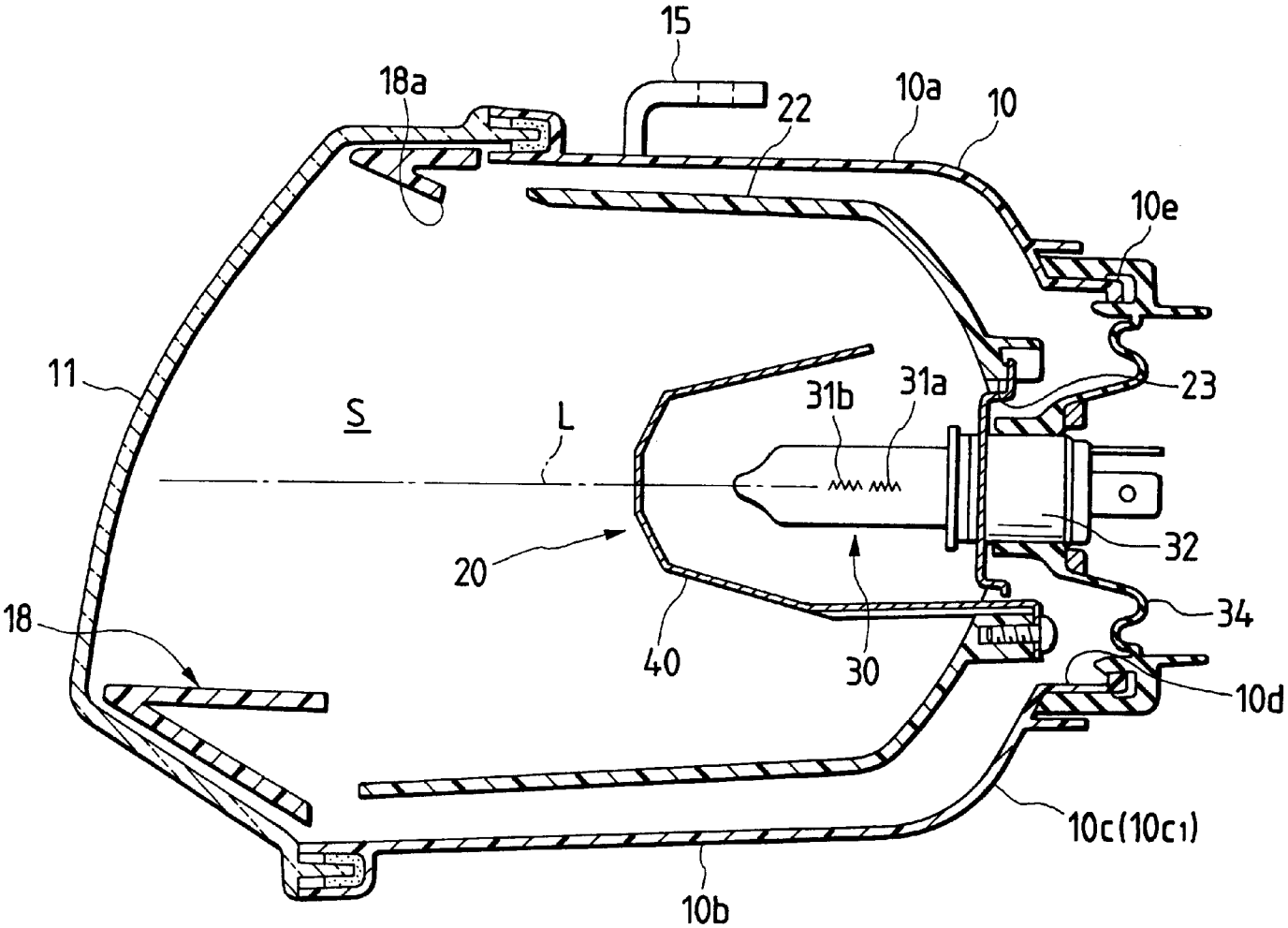
FIG. 3 is a longitudinal sectional view showing the headlamp taken along a line III—III in FIG. 1.
Figure 4:
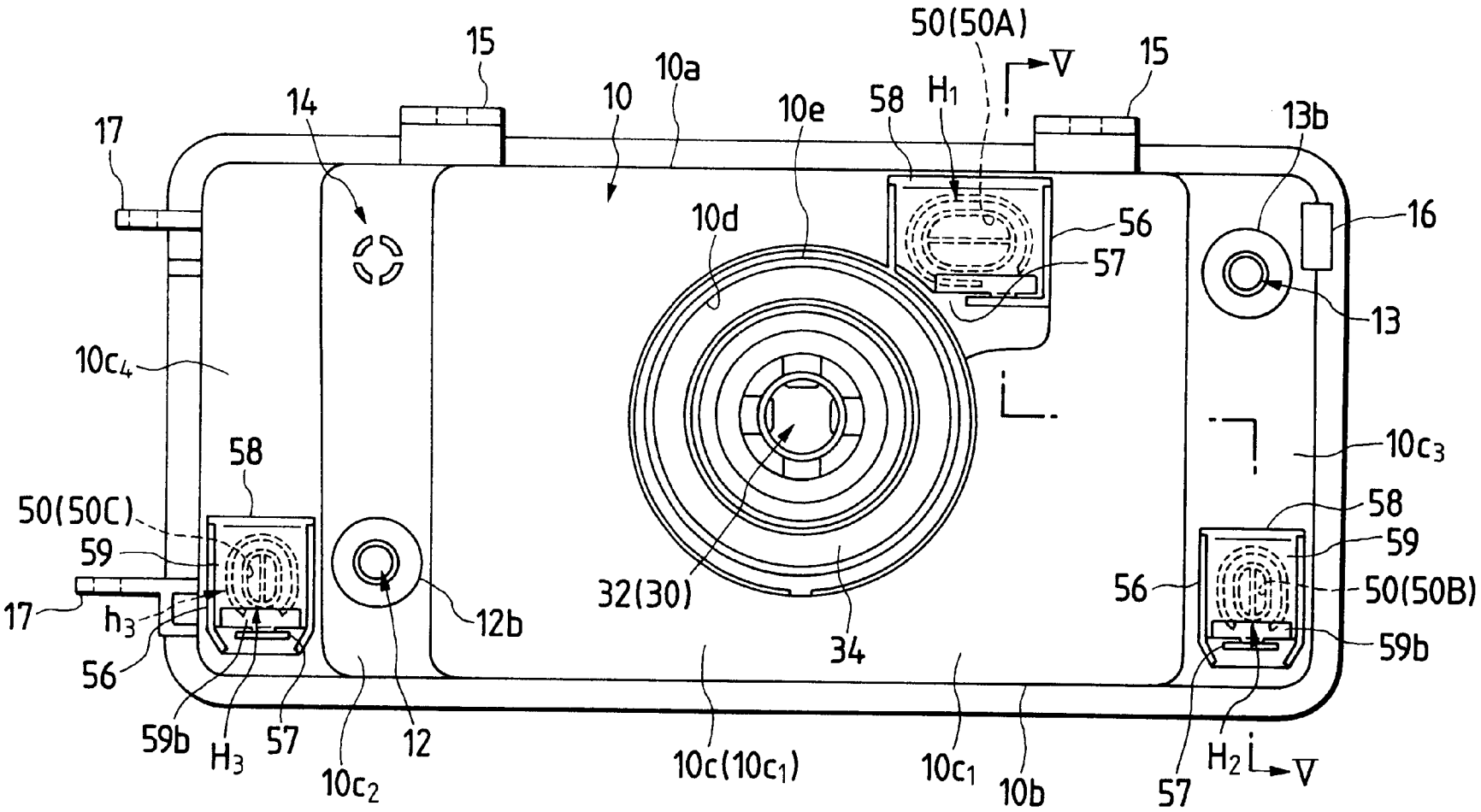
FIG. 4 is a rear view showing the headlamp.
Figure 5:
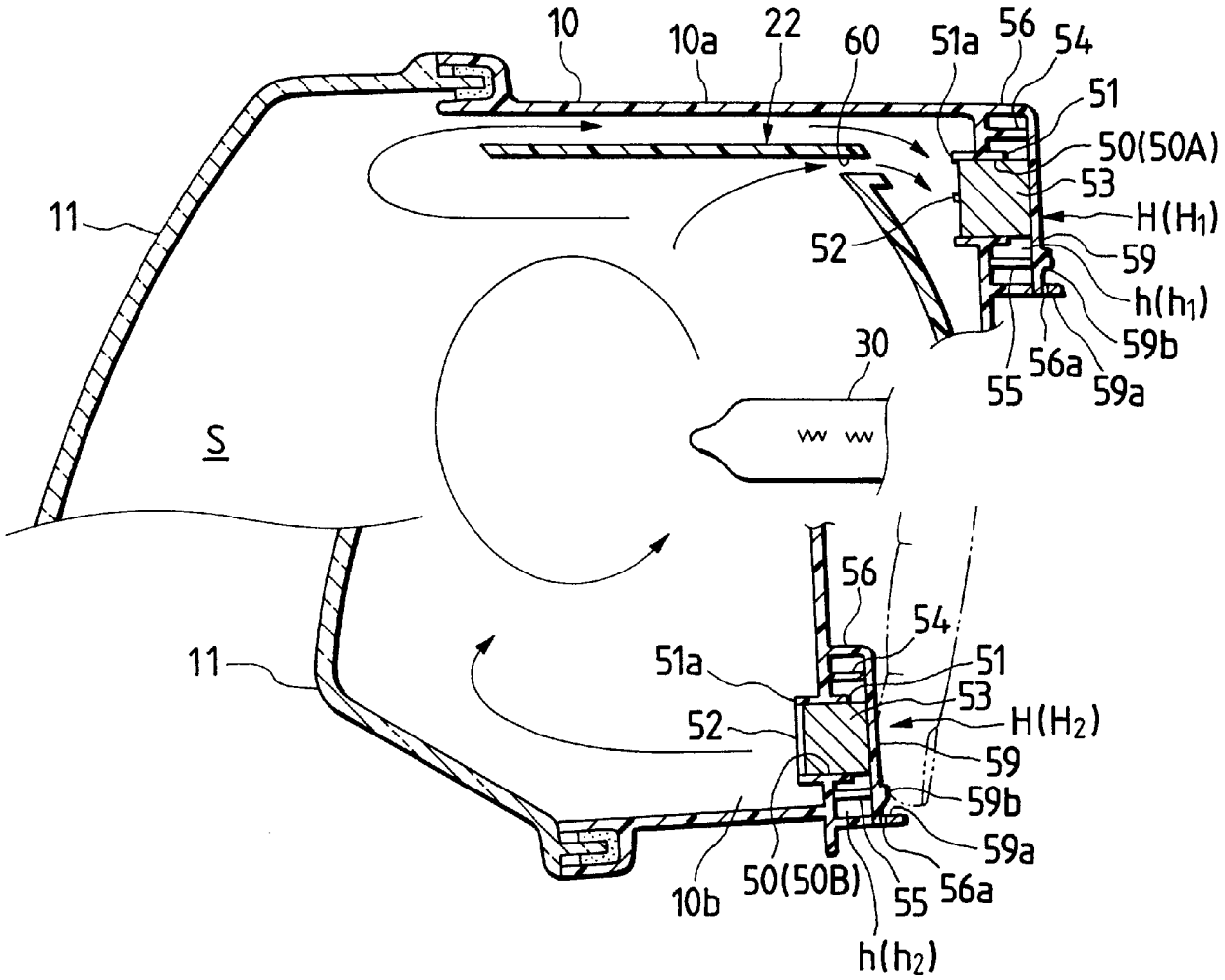
FIG. 5 is a longitudinal sectional view showing the headlamp taken along a line V—V in FIG. 4.
Figure 6:
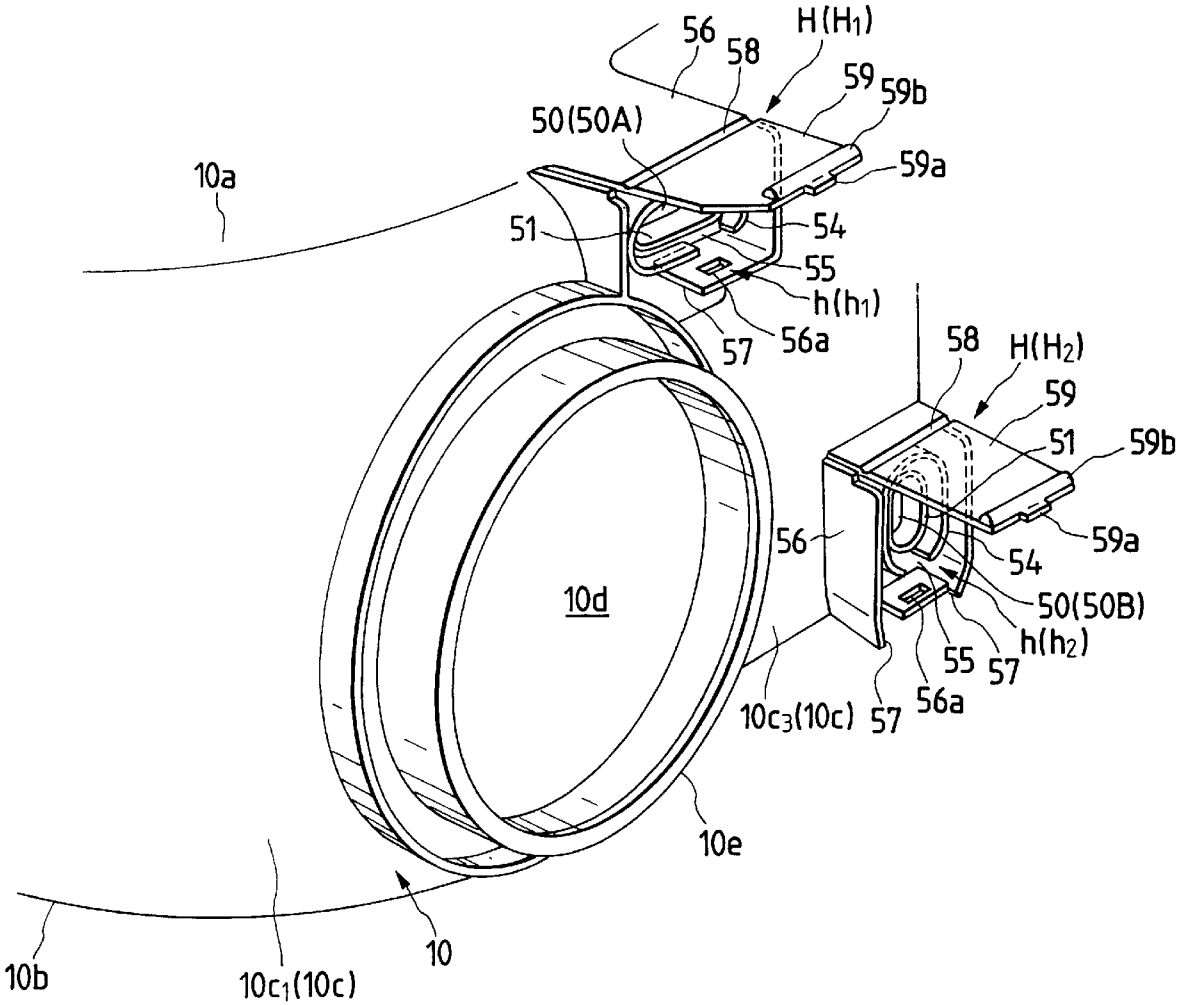
FIG. 6 is a perspective view showing an air hole and its vicinity on the rear side of the headlamp.
Figure 7:
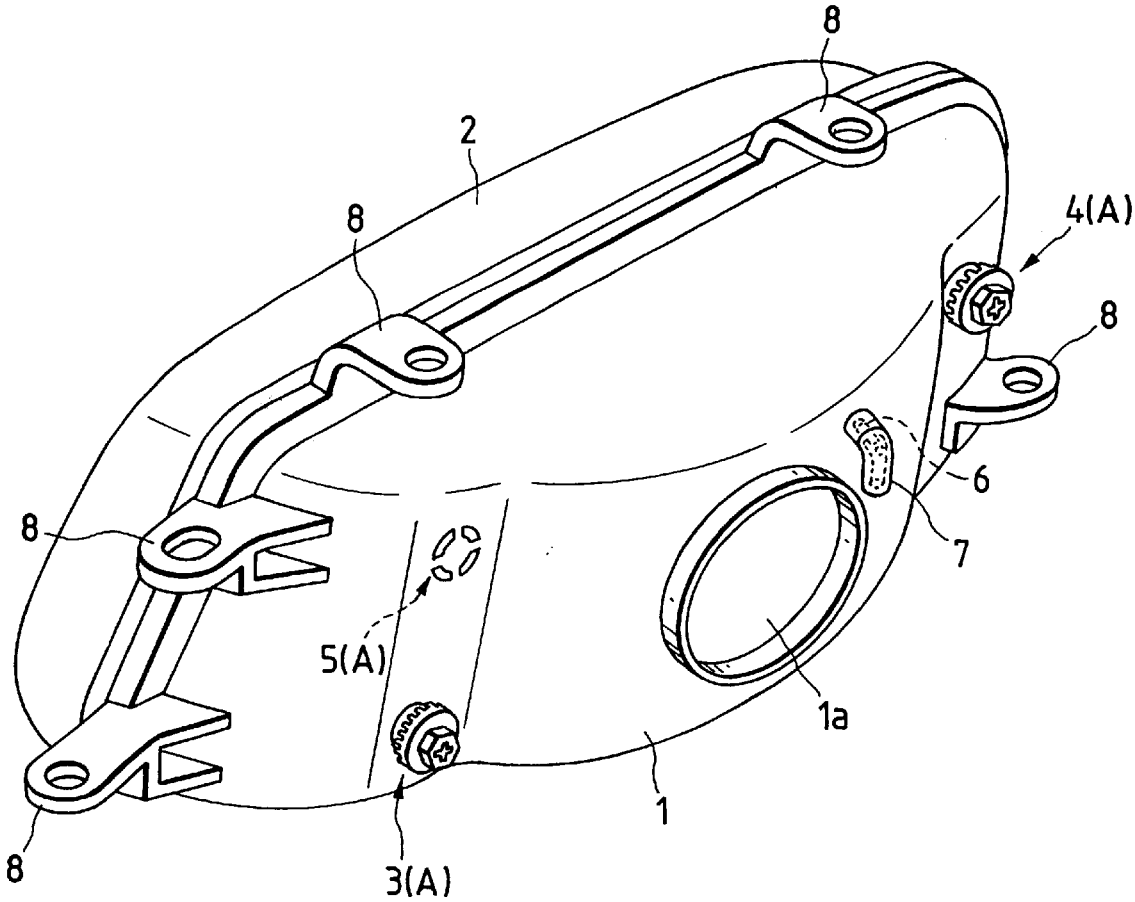
FIG. 7 PRIOR ART
FIG. 7 is a rear view in perspective of a conventional vehicular headlamp.
Figure 8:
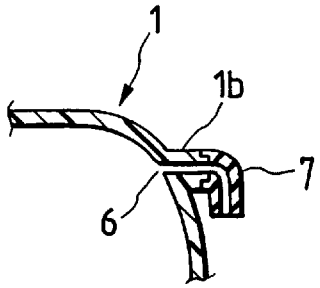
FIG. 8 PRIOR ART
FIG. 8 is a longitudinal sectional view showing an air hole and its vicinity on the rear side of the headlamp.

FIGS. 1 through 6 cooperate to show an embodiment of the present invention: FIG. 1 is a front view showing a vehicular headlamp constructed according to the present invention; FIG. 2 is a horizontal sectional view showing the headlamp (taken online II—II in FIG. 1); FIG. 3 is a longitudinal sectional view showing the headlamp (taken on line III—III in FIG. 1); FIG. 4 is a rear view showing the headlamp; FIG. 5 is a longitudinal sectional view showing the headlamp (taken on line V—V in FIG. 4); and FIG. 6 is a perspective view showing air holes and their vicinity on the rear side of the headlamp.

In those figures, a lamp body 10 is made of synthetic resin. The lamp body 10 is rectangular while being laterally elongated, and opened expanding from the front in the sideways direction. A transparent, curved front lens 11 is attached to the opening of the front of the lamp body 10, whereby a lamp chamber S is hermetically formed while being laterally rectangular in shape.

Within the lamp chamber S a lamp unit 20 is tiltably supported by an aiming mechanism formed with two aiming screws 12 and 13 and one ball joint 14. The lamp unit 20, which is of the reflection type, functions to form a main beam and a low beam.

The lamp unit 20 is constructed with a synthetic resin reflector 22, a bulb 30 and a shade 40. The reflector 22 includes a parabolic reflecting surface deposited with aluminum (mirror processed). The bulb 30 as a light source is inserted into and fixed to a bulb insertion hole 23, which is formed at the rear vertex of the reflector 22. The shade 40, for light distribution control, is fixed to the bulb insertion hole 23 by screw means while covering the front of the bulb 30.

The bulb 30, made of glass, contains a main-beam filament 31*a* and a low-beam filament 31*b*. In a state that the bulb 30 is fixed to the bulb insertion hole 23, the reflector 22 is positioned so as to be focused at a mid position between the filaments 31*a* and 31*b*. The main-beam filament 31*a*, when energized, emits a main beam, and the low-beam filament 31*b*, when energized, emits a low beam.

The lamp body 10 includes an upper wall 10*a*, a lower wall 10*b* and a rear wall 10*c*. A bracket 15 is attached onto the upper wall 10*a*. The lamp body is mounted on a vehicle body by means of the bracket 15. The lower wall 10*b* extends in parallel with the upper wall 10*a*. The rear wall 10*c*, curved rearward, is located between the upper and lower walls 10*a* and 10*b*. An opening 10*d* for bulb replacement is formed in the rear wall 10*c* of the lamp body 10. A bulb socket 32 of the bulb 30 is protruded rearward through the opening 10*d*. A rubber hood 34, which is expandable, is located between a cylindrical portion 10*e* forming the opening 10*d* and the bulb socket 32, to thereby close the rear opening (bulb replacing opening) 10*d* of the lamp body 10.

The lamp unit 20 is tiltably supported on the lamp body 10 by means of the two aiming screws 12 and 13 and the ball joint 14. The aiming screws 12 and 13 are rotatably supported on the rear wall 10*c* of the lamp body 10. A couple of nuts 12*a* and 13*a*, which are to be screwed into the aiming screws 12 and 13, are mounted onto brackets 22*a* and 22*a*, respectively. Those brackets protrude from the rear surface of the reflector 22. By turning the aiming screws 12 and 13, the nuts 12*a* and 13*a* are moved forward and backward along the aiming screws 12 and 13, respectively. Through the movements of the nuts, the lamp unit 20 is tilted about the horizontal axis Lx and the vertical axis Ly, whereby the optical axis L of the lamp unit 20 is tilted vertically and horizontally as well.

Crown gears 12*b* and 13*b* are integrally provided at the rear ends of the aiming screws 12 and 13, respectively. The aiming screws 12 and 13 may be turned by turning the crown gears 12*b* and 13*b*, respectively.

An extension reflector 18 ranges from the front opening of the lamp body 10 to the inner side of the front lens 11, and extends along the latter. The extension reflector 18 has an opening 18*a*, which is located corresponding to the reflector 22 of the lamp unit 20. The obverse side of the extension reflector 18 is deposited with aluminum (mirror processed), like the reflector 22. The extension reflector 18 thus mirror processed covers the periphery region of the lamp unit 20, and with provision of the extension reflector 18, the entire surface of the lamp chamber S looks like a uniform mirror surface. In this respect, the look of the headlamp is improved.

Three air holes 50A, 50B and 50C (generally represented by numeral 50) are formed in the rear wall 10*c* of the lamp body 10. Three air passage housings H1, H2 and H3 (generally represented by numeral H) are provided covering the air holes 50. The air holes 50 open into the air passage housings H, respectively. Further, labyrinthine air passages h1, h2 and h3 (generally designated by h), continuous to the outside, are formed in the air passage housings H, respectively. Communication between the inside and outside of the lamp chamber S is set up through those air holes 50 and labyrinthine air passages h. With those structures, the headlamp breathes to prevent moisture from being condensed on the front lens 11.

The opening 10*d* for bulb replacement is formed in the rear wall 10*c* as already stated. The rear wall 10*c* includes a central portion 10*c*1, and depressed portions 10*c*2 and 10*c*3 located on both sides of the central portion 10*c*1. The central portion 10*c*1 is curved along the reflector 22. The aiming mechanism and a bracket 16 for fixing the headlamp to the vehicle body, and the like are disposed on those depressed portions 10*c*2 and 10*c*3. A depressed portion 10*c*4 is located on the left side (when viewed from the rear side of the headlamp) of the aiming-mechanism receiving depressed portion 10*c*2. A bracket 17 by which the headlamp is mounted onto the vehicle body is protruded from the depressed portion 10*c*4. The first air hole 50A and the air passage housing H1 are provided on the central portion 10*c*1 of the curved rear wall 10*c* of the lamp body. The second air hole 50B and the air passage housing H2, and the second air hole 50C and the air passage housing H3 are, respectively, provided on the lower portions of the aiming-mechanism receiving portion (right) 10*c*3 and the bracket-forming depressed portion (left) 10*c*4.

The first air hole 50A is horizontally elongated. The housing Hi is rectangular, extending horizontally, like the enlarged air hole 50A. The housing H1 is provided at a location above and near the bulb-exchange opening 10*d* in the central portion 10*c*1 of the lamp body rear wall. The vertical length of the housing H1 is shorter than the horizontal length thereof.

The second air holes 50B and 50C are vertically elongated. The housings H2 and H3 are rectangular while oriented vertically, like the enlarged air holes 50B and 50C. The housings H2 and H3 are provided at locations below the bulb-exchange openings 10*d* in the right portion 10*c*3 and the left portion 10*c*4 of the lamp body rear wall.

The air present around and heated by the bulb 30 flows upward within the lamp chamber S, and smoothly flows out of the lamp chamber through the first air hole 50A. At the same time, outside air is introduced into the lamp chamber through the second air holes 50B and 50C. The result is that a stream of air by convection is formed within the lamp chamber. Thus, the lamp chamber S breathes through the air holes 50 (50A, 50B and 50C), so that no moisture is condensed on the front lens 11.

As shown in FIG. 5, an air passage hole 60 is formed in the rear wall of the reflector 22 at a position confronting the first air hole 50A. Air heated on the inner side of the reflector 22 passes outside the reflector 22 and flows to the first air hole 50A, and further passes through the air passage hole 60 and flows to the first air hole 50A (arrows in FIG. 5). In this way, the breathing action of the lamp chamber is activated.

The air holes 50 (50A, 50B and 50C) are elongated holes of large opening areas, whereby a sufficient amount of air flows through the lamp chamber S. The following air current is formed within the lamp chamber S: Outside air introduced into the lamp chamber S through the second air holes 50B and 50C, which are located in the lower portion within the lamp chamber S and closer to the right and left sides of the same, and is discharged out of the lamp chamber S through the first air hole 50A located at the central position in the upper portion within the lamp chamber S. The unique structure of the invention, which causes the above air current, successfully solves the following problem of the conventional headlamp: the convection air current C is entirely formed within the lamp chamber S; the warm air insufficiently circulates by convection within the lamp chamber S; and therefore, moisture is liable to be condensed at the corners of the front lens 11.

A cylindrical upstanding wall 51 passing through the rear wall 10*c* of the lamp body 10 forms each air hole 50. The upstanding wall 51 protruding rearward from the rear wall 10*c* almost blocks the entering of dust and water into the air hole 50 located within the upstanding wall 51. Further, a sponge-like filter 53 is put in the upstanding wall 51. The filter 53 enhances the dust- and water blocking function of the upstanding wall 51. Each of the air holes 50A, 50B and 50C is oval in cross section having radius R at both long diameter ends thereof. Since the filter 53 fits in the oval air hole 50, the filter can fill the entire space of the hole 50 without creating any gap. The feature improves water and dust proof performance.

A rib 52 is provided on the front side of the upstanding wall 51 while extending along each air hole 50. The rib 52 prevents the filter 53 from slipping off the upstanding wall 51 into the lamp chamber S. The rib 52 extends in the lengthwise direction of the air hole (elongated hole) 50, so that the short diameter width of the elongated hole is further reduced and the filter 53 is more reliably held within the upstanding wall 51.

The front end 51*a* of the upstanding wall 51, which forms the air holes 50, is protrudes into the lamp chamber S. In other words, the upstanding wall 51 protrudes less to the rear side of the lamp body. Therefore, the air passage housing H, provided covering the upstanding wall 51, protrudes less correspondingly.

A second upstanding wall 54 and a third upstanding wall 56 are further provided. The second upstanding wall 54 is disposed around the upstanding wall 51 of the rear wall 10*c* of the lamp body. The diameter of the opening of the second upstanding wall 54 is larger than that of the upstanding wall 51. The bottom portion of the second upstanding wall 54 is cut out in part. The second upstanding wall 54 is higher than the upstanding wall 51. The third upstanding wall 56, rectangular in cross section, is disposed around the second upstanding wall 54. The bottom portion of the third upstanding wall 56 is cut out in part. The third upstanding wall 56 is higher than the second upstanding wall 54.

It is noted that the cut-outs 55 and 57 of the second and third upstanding walls 54 and 56 are formed in the bottom portions of those upstanding walls. With provision of the cut-outs, even if water enters into the inside spaces of those upstanding walls 54 and 56, it is naturally discharged through those cut-outs.

The cut-outs 55 and 57 of the second and third upstanding walls 54 and 56 are arranged such that those cut-outs are not vertically aligned with each other. Since the upstanding walls are thus arranged on their cut-outs, if water enters through the cut-out 57 of the third upstanding wall 56, it rarely reaches the cut-out 55 of the second upstanding wall 54.

A thinned linear portion serving as a hinge 58 traverses the upper portion of the third upstanding wall 56. A swing cover 59 extends forward from and along the hinge 58. The swing cover 59 is used for covering the end opening of the third upstanding wall 56. The swing cover 59 has an engaging protrusion 59a at its free end. When the swing cover 59 is turned down to close the end opening of the third upstanding wall 56, the engaging protrusion 59*a* engages into an engaging hole 56*a* formed in the lower or bottom portion of the third upstanding wall 56.

The swing cover 59 is bent and turned down about the hinge 58, and the engaging protrusion 59*a* of the swing cover 59 is brought into engagement (lance engagement) with the engaging hole 56*a* of the third upstanding wall 56. Then, the end opening of the third upstanding wall 56 is closed with the swing cover 59, to thereby form the labyrinthine air passages h (h1, h2, h3) which are continuous to the lamp chamber S via the air holes 50 and to the outside of the lamp chamber S, through the cut-out 57. Also in the closing state of the swing cover 59, the dust-blocking filter 53 is pushed by the swing cover 59 and firmly held within the upstanding wall 51.

Thus, the labyrinthine air passages (h1, h2, h3) allowing the air holes 50 (50*a*, 50B, 50C) to be continuous to the exterior are formed by the second upstanding wall 54, the third upstanding wall 56 and the swing cover 59, which form the air passage housings H.

A rib 59*b* with a knob is attached to and along the free end of the swing cover 59. The rib 59*b* is helpful when the swing cover 59 is closed. To close the swing cover 59, the flat of a worker's finger is put on the rib 59*b* to be immovable (as indicated by a phantom line in FIG. 5). Therefore, a pressing force by the finger is efficiently transmitted to the swing cover 59 to bend and turn the swing cover 59, so that the engaging protrusion 59*a* fits smoothly into the engaging hole 56*a*.

It is noted that the air passage housings H (H1, H2, H3) are formed integrally with the lamp body 10, while the flexible tube is separated from the lamp body and attached thereto in the conventional device. This structural feature contributes to a reduction of the number of the parts required for constructing the vehicular lamp. The labyrinthine air passages h (h1, h2, h3) may be constructed in a simple manner such that the swing cover 59 is bent and lance coupled with the lower edge of the third upstanding wall. In this respect, the air passage constructing work is very easy.

While in the embodiment mentioned above, the invention is incorporated into the vehicular headlamp, it is clear that the invention is applicable to any other suitable vehicular lamp in a similar way.

As seen from the foregoing description, in the vehicular lamp of the invention, the air holes for breathing action are the elongated holes.

The air holes each having a sufficiently large diameter may be formed at given locations on the rear wall of the lamp body without interfering with the light-source-exchange opening, and the like. Therefore, a satisfactory air flowing between the inside and outside of the lamp chamber is secured, and hence a reliable prevention of formation of the dew on the front lens is secured. There is less restriction on the locations to form the air holes so as to increase design freedom in designing the lamp body.

Further, in the vehicular lamp of the invention, dust particles and water are blocked by the dust-blocking filter put in the upstanding wall (air hole). The dust and water blocking function in the air hole is guaranteed for a long time. The dust-blocking filter is tightly put in the upstanding wall, providing a reliable dust/water blocking function.

Further, the rib prevents the dust-blocking filter put in the upstanding wall (air hole) from slipping off the upstanding wall into the lamp chamber. The dust-blocking filter may be put within the upstanding wall in a simple manner, and stably be held therewithin for a long time.

Further, in the vehicular lamp of the invention, the upstanding wall protrudes less from the rear side of the lamp body, and hence the space on the rear side of the lamp body is correspondingly broadened. This reduces the possibility that the upstanding wall interferes with other members and the like.

In the vehicular lamp, further, the labyrinthine air passage communicating with the air hole within the air passage housing reliably blocks the dust particles and water from entering the air hole.

The air hole is located higher than the air passage, which provides a communication between the inside and outside of the air passage housing. This feature ensures the dust-and water-blocking function for the air hole.

The labyrinthine air passage forming member (housing) is formed integrally with the lamp body. This feature contributes to a reduction of the number of required component parts. The lance coupling enables a mere closing of the swing cover to form the air passage. This leads to simplification of the headlamp assembly.

In the vehicular lamp, air heated by the light source rises, and smoothly flows out of the lamp chamber through the air hole located above and near the light source.

In the vehicular lamp, an active stream of air flows from a location below the light-source-exchange opening and close to the side end of the right or left portion to the central portion above the lamp chamber. Therefore, the air stream flows through the entire space within the lamp chamber.

In the lamp of the invention, moreover, the first air hole formed in the region which is narrow in the vertical direction and above and near the light-source-exchange opening, is horizontally oriented, and the second air hole formed in the region which is narrow in the horizontal direction and close to the side end of the right or left portion of the rear wall of the lamp body, is vertically oriented. With this structure, the air hole of sufficiently large diameter may be formed at a desired location on the rear wall of the lamp body, without interfering with the bulb-exchange opening, the aiming mechanism, the mounting bracket, and the like.

What is claimed is:

1. A vehicular lamp comprising:

a lamp body having a front opening;

a front lens coupled to the front opening of the lamp body;

a closed lamp chamber defined by the lamp body and the front lens;

a light source disposed within said lamp chamber; and first and second air holes formed in the rear wall of said lamp body, said first and second air holes being elongated in shape, wherein A) each of said first and second air holes is covered with an air passage housing for defining labyrinthine air passages continuous to the outside of the lamp chamber, said air passage housing of said first air hole being elongated horizontally in the same direction in which said first air hole is elongated and said air passage housing of said second air hole being elongated vertically in the same direction in which said second air hole is elongated, so that said air passage housings are elongated in directions that are perpendicular to each other, wherein said air passage housings are rectangular-shaped housings; and B) said air passage housings comprising:

a) a second upstanding wall having a cut-out in a bottom portion and being disposed around an upstanding wall, b) a third upstanding wall having a cut-out in a bottom portion and being disposed around said second upstanding wall, said cut-out of said third upstanding wall being not horizontally aligned with said cut-out of said second upstanding wall, and c) a swing cover being extended rearward from and along a thinned linear portion serving as a hinge which traverses an upper portion of said third upstanding wall, when said swing cover is lance coupled with the bottom portion of said third upstanding wall, said swing cover covering an end opening of said third upstanding wall.

2. The vehicular lamp according to claim 1, wherein each of said first and second air holes comprises a cylindrical upstanding wall penetrating through the rear wall of said lamp body so as to protrude towards the outside of the lamp chamber, a dust-blocking filter disposed in said upstanding wall, and a rib disposed on the front side of said upstanding wall, extending in the lengthwise direction of elongation of said first and second air holes.

3. The vehicular lamp according to claim 2, wherein said front end of said upstanding wall protrudes into said lamp chamber.

4. The vehicular lamp according to claim 1, wherein one of said first and second air holes is provided at a location above and near a light-source-exchange opening.

5. The vehicular lamp according to claim 1, wherein said first air hole is provided at a location above and near a light-source-exchange opening, and a second air hole is provided in one of right and left portions of the rear wall of said lamp body at a location below said light-source-exchange opening and close to a side end of the right or left portion.

6. The vehicular lamp according to claim 1, wherein each of said first and second air holes is oval in cross section, and comprises an upstanding wall, and further comprises a filter filled in at least one of said oval air holes.

7. The vehicular lamp according to claim 1, further comprising:

a reflector disposed within said closed lamp chamber, wherein an air passage hole is formed in said reflector at a position confronting said first air hole.

8. A vehicular lamp comprising:

a lamp body having a front opening;

a front lens coupled to the front opening of the lamp body;

a closed lamp chamber defined by the lamp body and the front lens;

a light source disposed within said lamp chamber; and air holes formed in a rear wall of said lamp body, said air holes being elongated in shape, wherein said air holes are covered with an air passage housing for defining labyrinthine air passages continuous to the outside of the lamp chamber, said air passage housing being rectangular-shaped and elongated in the same direction in which said air holes are elongated.

* * * * *